US005331705A

United States Patent [19]

Melov

[11] Patent Number: 5,331,705

[45] Date of Patent: Jul. 26, 1994

[54] CLEANING AID

[76] Inventor: Martin Melov, 256 Malabar Road, Maroubra, New South Wales, Australia

[21] Appl. No.: 76,006

[22] Filed: Jun. 11, 1993

[30] Foreign Application Priority Data

Jun. 15, 1992 [AU] Australia ..... PL2944

[51] Int. Cl.[5] ..... A47L 13/12

[52] U.S. Cl. ..... 15/118; 15/209.1; 273/32 A; 273/32 B

[58] Field of Search ..... 15/105, 118, 208, 209.1, 15/210.1; 273/32 A, 32 B

[56] References Cited

U.S. PATENT DOCUMENTS

| | | | |
|---|---|---|---|
| 2,230,312 | 2/1941 | Sieb et al. | 15/118 |
| 2,654,191 | 10/1953 | Pusch | 15/118 |
| 2,778,044 | 1/1957 | Mikulski | 15/118 |
| 2,875,461 | 3/1959 | Anderson | 15/118 |
| 2,910,710 | 11/1959 | Corrington et al. | 15/118 |
| 3,169,264 | 2/1965 | Walker | 15/118 |
| 3,938,570 | 2/1976 | Stewart | 273/32 A |
| 4,912,800 | 4/1990 | Zeltner | 15/210.1 |
| 4,974,763 | 12/1990 | Widrig | 273/32 B |
| 5,060,943 | 10/1991 | Stoffo | 273/32 B |
| 5,075,918 | 12/1991 | Zeltner et al. | 15/208 |

FOREIGN PATENT DOCUMENTS

| | | | |
|---|---|---|---|
| 201716 | 8/1923 | United Kingdom | 15/209.1 |

*Primary Examiner*—Philip R. Coe
*Assistant Examiner*—Mark Spisich
*Attorney, Agent, or Firm*—Smith-Hill and Redell

[57] ABSTRACT

A cleaning aid comprises a towel having a cleaning cloth stitched over part of its area. A fibrous scouring pad is stitched over part of the cloth. The pad allows wet dirt lumps to be removed from a contaminated surface after which dirt streaks and moisture can be removed by the cloth. The user can then wipe his hands on the towel. The cleaning aid is itself cleanable by washing machine.

7 Claims, 1 Drawing Sheet

CLEANING AID

FIELD OF THE INVENTION

This invention relates to a cleaning aid. More specifically it is concerned with a flexible cleaning aid capable of removing lumps of wet dirt from a hard surface and of being readily easily cleaned afterwards.

STATE OF THE ART

It is not uncommon in towns to have one's footwear soiled by evil-smelling faecal matter deposited by dogs on a sidewalk. The removal of such dirt is unpleasant and one has to resort to a stick and subsequent rubbing of the shoes on a hard kerb or on grass to remove the worst of the dirt before entering a house. Golfers also encounter a similar problem when the playing surfaces of their clubs become soiled with lumps of wet earth which have to be removed entirely if subsequent use of the club is to be reliable.

U.S. Pat. No. 3,982,298 describes a fabric glove having bristle pads on its tips to enable heavy soiling of footwear to be removed and the shoe subsequently cleaned. The specification is however silent on how the glove is cleaned for re-use.

U.S. Pat. Nos. 4,912,800 and 5,075,918 both describe a cleaning towel adapted to be used by a golfer to remove lumps of dirt from a golf ball, the towel having a bristle brush either permanently or releasably attached to it. The bristles are used to remove the dirt lumps anti the towel can then be used by the golfer to dry his hands so that they will not slip on the handle of the golf club when executing the next stroke.

All three of the above proposals tail to disclose a way of removing the dirt lumps which have been transferred from the surface being cleaned, from between the bristles of the bristle brush. It is not practical to place a combination of bristle brush and towel in a washing machine as the hard brush can damage fabric items placed in the washing machine at the same time, and the violent motion to which the combination is subjected during operation of a washing machine will quickly damage the connection between the towel and the brush and may also impair the correct functioning of the washing machine.

The more recent of the above two United States patents suggests attaching the bristle brush to the towel in a releasable manner which would enable it to be cleaned separately. However the provision of a releasable connection would substantially increase the cost of the cleaning aid. Moreover, although the bristle brush will remove solid wet lumps of dirt from a hard surface, it will normally leave dirt streaks on the surface and in grooves in the surface. In the case of footwear soiled by dog droppings, the evil smell on the footwear will persist in the case of a golf driving club, the grooves on the driving face of the club should be clean if a drive is to be correctly executed as otherwise the golf ball will slide on the face at tile moment of impact and spoil the accuracy of the drive.

A first object of the invention is to provide a cleaning aid which can be relatively cheaply manufactured and will be durable.

A second object of the invention is to provide a cleaning aid which is easy to use and is effective to thoroughly clean wet dirt from a hard and non-smooth surface.

A third object of the invention is to provide a cleaning aid which is itself easy to clean.

SUMMARY OF THE INVENTION

A cleaning aid is provided with three discrete cleaning areas respectively formed on one side by a flexible fibrous pad for removing solid lumps of dirt from a hard surface to be cleaned; a smooth cloth for wiping residual dirt streaks from the hard surface; and, a towel to enable the user to wipe his hands dry after using the cleaning aid.

PREFERRED FEATURES OF THE INVENTION

The three areas of the cleaning aid are preferably provided by stitching to one face of a hand towel a smooth cleaning cloth over say a third of one face of the towel to provide the wiping area, and stitching a fibrous scouring pad such as a SCOTCHBRITE kitchen-scouring pad, over about one third of the area of the cleaning cloth.

If the cleaning aid is to be designed for use by a golfer, it preferably has a metal grommet in one corner zone of one end portion of the towel, the cleaning cloth and pad being stitched to the other end of the towel. When the cleaning aid is hung by the grommet from a golf bag, the wettest parts of it—which are the fibrous pad and wiping cloth—are located at the lower end of the aid so that gravity migration of moisture from the wettest to the driest parts of the towel is minimised.

It is also convenient to provide the towel with a press-stud adjacent the grommet, to enable a golf ball marker to be attached to the towel.

INTRODUCTION TO THE DRAWING

The invention will now be described, by way of example, with reference to the accompanying drawing, in which:

IN THE DRAWING

DESCRIPTION OF PREFERRED EMBODIMENT

Figure 1:
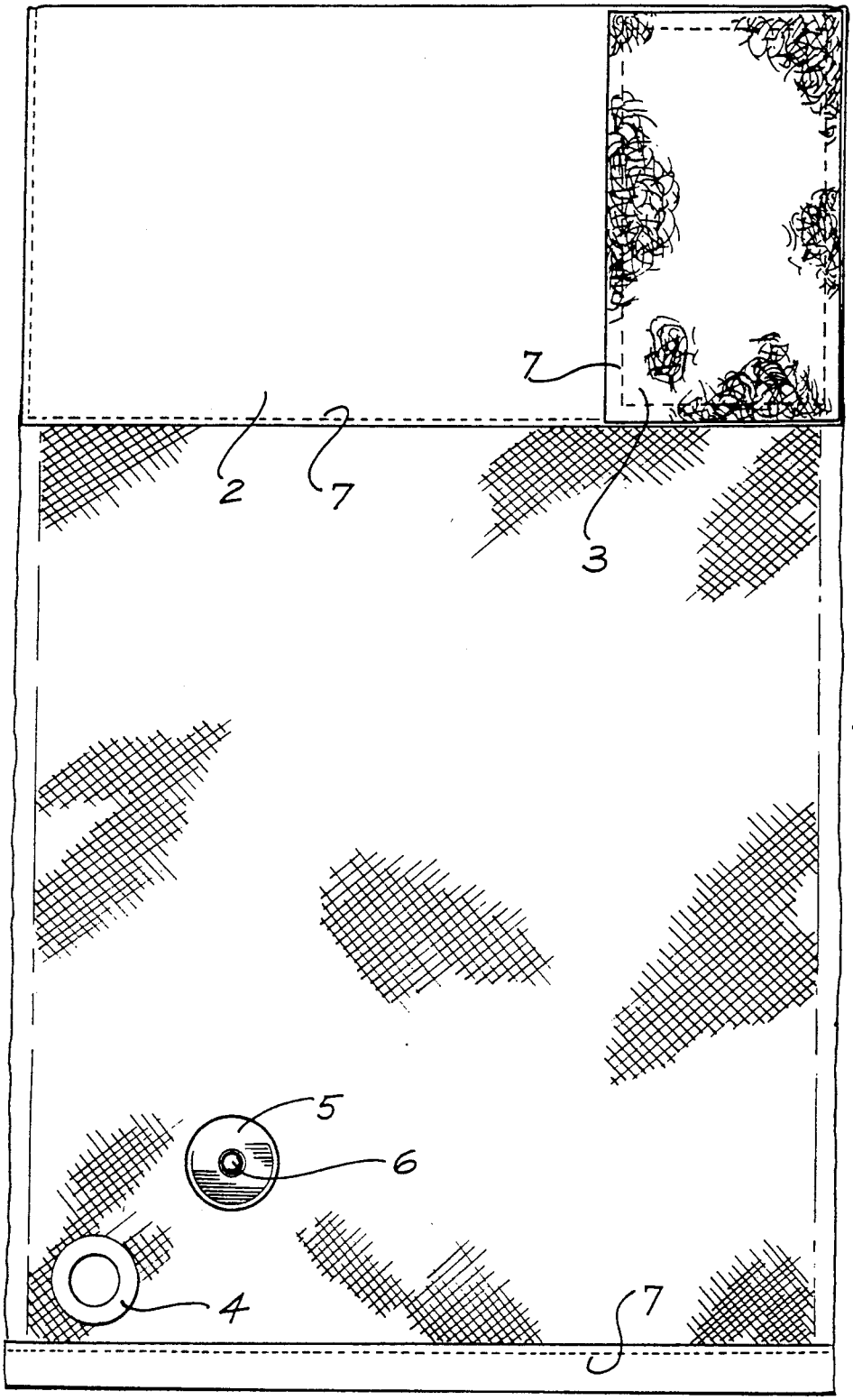
FIG. 1 is a plan view of a cleaning aid.
Figure 2:
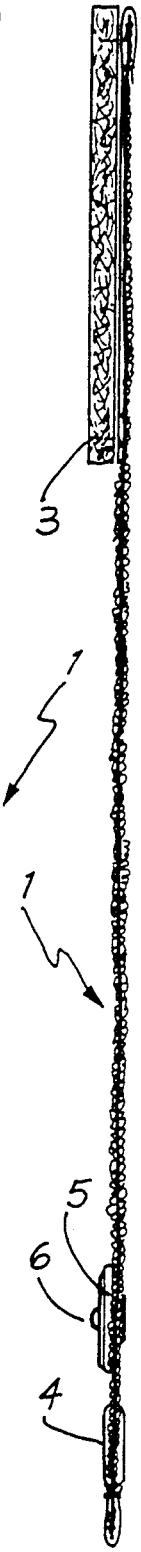
FIG. 2 is an edge view of the cleaning aid as seen from the right-hand side of FIG. 1.

The cleaning aid comprises a small rectangular hand towel 1 approximately fifty centimeters long and thirty centimeters wide which has a soft rectangular wiping cloth 2 about thirty centimeters long and fifteen centimeters wide, covering one end-portion of one side of the towel. The other side of the towel is fully exposed. A rectangular scouring pad 3 made from soft packed synthetic filament material and about fifteen centimeters by nine centimeters, covers one end-portion of the cloth 2.

The towel 1 is made from 'terry' towelling. The cleaning cloth is a domestic cleaning cloth commercially available in Australia under the registered trade mark "JIF", and the pad is a kitchen scouring pad commercially available in Australia under the registered trade mark SCOTCHBRITE.

The towel 1 is provided at its diagonally opposite corner region to the pad 3, with a brass grommet 4 to enable the cleaning aid to be hung from a hook on an upper end of a golf bag (not shown). A golf-ball marker 5 is detachably fitted by a press-stud 6 to the same corner region of the towel as the grommet 4. Lines of stitching 7 secure the wiping cloth 2 and the scouring pad 3 to the towel 1. Suitably the colour of the wiping cloth 2 contrasts with that of the scouring pad 3 and the towel 1.

USE OF PREFERRED EMBODIMENT

A golfer carries the cleaning aid suspended from the hook on the outside upper end of his golf bag. If either his ball or his club driving face becomes contaminated with dirt, he detaches the cleaning aid and, if necessary, marks the position of the lifted golf-ball with the marker 5. He then removes lumps of the dirt with the scouring pad 3, and any residual dirt streaks and moisture droplets, with the wiping cloth 2. He then wipes his hands on the towel and re-hangs it on the hook so that it is ready for re-use. It will be noted that when the cleaning aid is hanging from the hook, the wettest and dirtiest parts of it are at the lower end so that gravitational migration of moisture from these parts to the rest of the towel is minimised and the portion of the towel on which the hands are wiped stays relatively dry.

After use, the cleaning aid may itself be readily cleaned in washing machine or by hand-washing, as it has no sharp corners or hard and relatively heavy area.

It should be observed that the lines of stitching 7 securing the pad 3 in place, terminate short of the edges of the pad. These edges are thus opened up slightly and expose the ends of the fibres of the pad to provide an additional rough brush-like surface capable of entering the grooves on the driving face of a golf club and scouring dirt from them in a thorough manner.

I claim:

1. A cleaning aid comprising:

a hand towel having spaced opposite end portions;

a cleaning cloth partly covering one face of said towel at one of said end portions;

a scouring pad also arranged on said one face and at said one end portion of the towel alongside at least a portion of said cleaning cloth; and a hanging element at the second end portion of said towel for hanging the cleaning aid from a hook, the pad, the cloth and the towel being permanently attached to one another.

2. A cleaning aid as set forth in claim 1, in which the cloth covers said one end-portion of said one face of the towel, and the pad covers a portion of the cloth.

3. A cleaning aid as set forth in claim 2, in which the pad, the cloth and the towel are each rectangular and they are attached to one another by lines of stitching.

4. A cleaning aid as set forth in claim 3, in which the pad and the cloth are attached to only one face of the towel.

5. A cleaning aid as set forth in claim 1, in which the hanging element is a grommet that is attached to the towel in the diagonally opposite corner region diagonally opposite to said pad.

6. A cleaning aid as set forth in claim 5, including a snap attached to the towel adjacent the grommet, and a golf-ball marker releasably secured to the snap.

7. A cleaning aid comprising:

a generally rectangular hand towel having two opposite faces, first and second opposite end portions, and first and second opposite corner regions, a smooth cleaning cloth having two opposite faces, said cleaning cloth partly covering one face of said towel and sewn to the hand towel at said first end region thereof in face-to-face relationship, a scouring pad having two opposite faces, said scouring pad being sewn to the cleaning cloth and towel in face-to-face relationship at the first corner region of the towel, a substantial portion of the cleaning cloth being exposed adjacent the scouring pad, and a grommet at the second corner region of the towel, whereby the cleaning aid may be hung from a hook.

* * * * *